US007290358B2

(12) United States Patent
Francis

(10) Patent No.: US 7,290,358 B2
(45) Date of Patent: Nov. 6, 2007

(54) APPARATUS FACILITATING WALKING IN SKI BOOTS

(76) Inventor: Charles Jelinek Francis, Novobranska 20, Brno (CZ) 602 00 Brno ( * ) Notice: Subject to any disclaimer, the term of this patent is extended or adjusted under 35 U.S.C. 154(b) by 206 days.

(21) Appl. No.: 10/522,072

(22) PCT Filed: Dec. 2, 2002

(86) PCT No.: PCT/US02/38422

§ 371 (c)(1),
(2), (4) Date: Jan. 21, 2005

(87) PCT Pub. No.: WO2004/010809

PCT Pub. Date: Feb. 5, 2004

(65) Prior Publication Data

US 2006/0010719 A1 Jan. 19, 2006

Related U.S. Application Data

(60) Provisional application No. 60/399,226, filed on Jul. 25, 2002.

(51) Int. Cl.
*A43B 5/04* (2006.01)
*A43B 3/10* (2006.01)

(52) U.S. Cl. ..... 36/132; 36/7.5; 36/7.6

(58) Field of Classification Search ..... 36/132, 36/7.5, 117.4
See application file for complete search history.

(56) References Cited

U.S. PATENT DOCUMENTS

| | | | | |
|---|---|---|---|---|
| 4,160,301 | A * | 7/1979 | Woolley | 12/120.5 |
| 4,199,880 | A | 4/1980 | Frey | 36/132 |
| 4,228,602 | A | 10/1980 | Groves | 36/132 |
| 4,286,397 | A | 9/1981 | Booty | 36/132 |
| 4,461,104 | A | 7/1984 | Calkin et al. | 36/132 |
| 4,542,599 | A | 9/1985 | Annovi | 36/117 |
| 4,570,363 | A | 2/1986 | Annovi | 36/117 |
| 4,619,059 | A | 10/1986 | Koniuk | 36/132 |
| 4,727,662 | A | 3/1988 | Ilon | 36/132 |
| 4,811,504 | A | 3/1989 | Bunke | 36/132 |
| 4,843,672 | A | 7/1989 | Fasse | 12/120.5 |
| 4,958,445 | A | 9/1990 | Brisco | 36/7.5 |
| 5,154,682 | A | 10/1992 | Kellerman | 36/44 |
| 5,481,814 | A | 1/1996 | Spencer | 36/138 |
| 6,044,578 | A * | 4/2000 | Kelz | 36/7.5 |

FOREIGN PATENT DOCUMENTS

| | | |
|---|---|---|
| FR | 0036380 | 9/1981 |
| FR | 0008125 | 12/2001 |

* cited by examiner

*Primary Examiner*—Ted Kavanaugh
(74) *Attorney, Agent, or Firm*—Edwin A. Skoch

(57) ABSTRACT

An apparatus, in its first, second, and third embodiments, that is intended to be temporarily attached to the soles of ski boots, whenever the wearer is not attached to skis and desires the ability to comfortably walk or desires protection for the soles of the ski boots. The first three embodiments generally comprise of sandal-like soles made of a resilient, elastic, springy material, which aids in the natural walking action by alternately compressing and releasing, adding energy to the step, thereby aiding walking while wearing ski boots. A fourth embodiment is made by altering the ski boots themselves so that the heel (41) and toe (40) sections of the boot are hinged (42) to the underside of the boot, and contain a spring that adds energy to each step taken by the user. The hinged sections are pinned against the boot while skiing.

2 Claims, 5 Drawing Sheets

APPARATUS FACILITATING WALKING IN SKI BOOTS

TECHNICAL FIELD

This invention relates primarily to ski boot accessories and devices facilitating more natural ambulation while wearing ski boots, more particularly, in the first, second, and third embodiments, attachments to the soles of ski boots that protect those soles and aid in walking while wearing ski boots. A fourth embodiment is an alteration to the boot itself, providing a springing function on the heel and ball of the boot—alternately—while walking. The general technical fields involved are footwear sole technology and skiing boot technology.

BACKGROUND ART

The modern downhill ski boot is meant to rigidly attach flat against the ski surface, so as to provide the wearer with as much control over the ski as possible. Skis and ski boots, while coupled together, essentially act as a single, rigid unit, transferring torques and forces from the point of contact with the earth to the wearer's legs, feet, and ankles.

With this aim in mind, a ski boot is also as rigid as possible, so as to prevent the user's foot from flexing, turning side to side, rocking front to back, or rolling side to side. Further, the ski boot is meant to keep the ankle and foot in a set, acute angle with respect to each other. This is because skiing is best performed with bent knees; bending the knees forces the ankles and feet into an acute angle.

These mechanics are inherently incompatible with the basic mechanics of walking. With each normal walking stride, the feet flex and rock front to back, and the ankle joint flexes freely, allowing the foot-to-ankle angle to change continually through the stride. As such, ski boots perform their skiing task well, but are ill designed for walking. Walking about in ski area parking lots, stairs, ski lodges, sidewalks, and apres-ski snackbars and lounges is a difficult, loud, uncomfortable, and even comic affair.

Further, walking on hard surfaces with ski boots damages the soles of the boots, which are usually made of a rigid plastic, and which can ultimately lead to the need to replace the boots.

Taking the boots off for walking is often not an option because regular footwear is stored away in lockers or left in automobiles. Moreover, taking the boots on and off is cumbersome and time consuming, and it is heavy to carry the boots, and so users often forgo this option.

Many have attempted to overcome this problem using various designs of ski boot soles or ski boot sole attachments. The most common invention in the prior art utilizes a bulky, attached curved or angled lower walking surface that essentially allows the boot to rock back to front over the curved or angled surface. (See, e.g., Groves '602, Booty '397, Calkin '104, Bunke '504.)

Another approach has been to alter the sole of the ski boots themselves, to provide for a more natural walking gait, once again using curved or angled surfaces, which, in this case, are fixed onto the bottom of the ski boot. (See, e.g., Brugger-Stuker '144, Weninger '179, Kastinger '309.) With this second general approach, typically, the boot's sole is mechanically repositioned and the walking surface on the bottom of the boot is physically altered by the user, once the boot is unattached from the ski. Various methods have included flipping a hinged piece down under the boot sole, or moving the boot's sole into a new position.

An inherent problem in the prior art of using attachments or these alterations to ski boots themselves is that the attachments and alterations are bulky because of their curved or angled nature. Curved pieces take up extra room and can make use unnecessarily complicated. Separate curved attachments are hard to stack together, do not stack flat, and take up more room in a backpack or bag.

Another inherent problem in the prior art mentioned above is weight. The materials needed to construct a rigid undersole can be heavy, adding weight to already heavy ski boots and making carrying of the undersoles difficult when not in use. Once again, this added weight makes carrying attachments in a backpack or bag uncomfortable and undesirable.

Similarly, by their rigid nature, curved attachments are more cumbersome to carry than attachments that are flexible and relatively soft. A few have taken the approach of a soft, flexible undersole attachment, such as Koniuk '059 and Kelz '578, but these approaches have their own inherent limitations as well. Kelz '578, in particular, is only designed to help with traction, not the walking motion; they provide no assistance with the motion of walking. The attachment in Koniuk '059, while softer than the prior approaches, sacrifices traction through the use of a curved attachment and adds the problems of bulk mentioned above.

Moreover, the prior art is replete with overly complicated attachment methods, such as front and rear clips. (See, e.g., Frey '880.)

The invented apparatus solves the problems inherent in the prior art, as summarized below.

SUMMARY, ADVANTAGES, AND COMMERCIAL APPLICABILITY OF THE INVENTION

This apparatus for walking in ski boots, in its first, second, and third embodiments, is a simple sandal-like attachment to the bottom of ski boots, to be put on while the boots are unattached from skis and the user desires to walk or lounge around in ski boots.

In its first and second embodiments, the claimed invention attempts to solve the above-mentioned problems using a simple, lightweight, relatively flat cushion that attaches to the bottom of ski boots, either by bootstraps, as in the first embodiment, or clips, as in the second embodiment. The invention acts like a sandal or pad worn on the bottom of the ski boot.

The third embodiment, while maintaining the same utility, functionality, advantages, and roughly the same shape as the first embodiment, uses a different attachment means. The invention is separated into two halves, connected by a spring mechanism, which pulls the two halves together, thereby holding grabbing and holding the ski boot bottom between the ends of the apparatus.

All three of these embodiments use one or more of a myriad of materials, so long as the basic, required functions are satisfied: the material can be compressed under pressure, is sufficiently resilient to return to its original shape when not under pressure, and provides springiness and energy return while returning to its original shape. The material must return to its original shape and width after each step and must be sufficiently durable to act in this function over the desired life of the product. Any material must return energy to the wearer while walking, such that the attachment aids in the walking motion by adding springiness to the step.

The attachment's basic material should be an elastomer or elastomeric foam. Although it is not necessary for the invention, suggested materials include polymers like EVA (ethylene vinyl acetate), "Neoprene" (polychloroprene), or polyurethane foam. Foam can be "closed" or "open cell," depending on manufacturing constraints and/or desired lifespan of the product. These materials are widely commercially available.

The fourth embodiment of the invention solves the same prior art problems, but takes a different approach and is actually integrated into the boot itself, at the heel and toe, providing springing while walking. This embodiment does not provide the same protecting function to the sole of the boot, but it eliminates the need for carrying attachments and solves the other problems inherent in the prior art, as with the first, second, and third embodiments. For example, it provides the same aids in ambulation as these other embodiments.

The first, second, and third embodiments can be summarized as follows: the upper side of the invented apparatus is flat, and presses flat against the sole of the ski boot. It is held against the sole while attached. The underside of the invented apparatus is also approximately flat. In cross-section, laterally, the invented apparatus is approximately rectangular.

The first embodiment is attached using straps which run underneath or through the invented apparatus and whose ends extend around the top of the ski boot and clasp together. The second embodiment is attached using an integrated clipping mechanism at the toe ends of the apparatus. The third embodiment is shaped in the same fashion, but is sectioned in two connected halves which slide apart longitudinally and then together to accommodate and then spring together to grasp the bottom of a ski boot.

These three embodiments solve several problems inherent in the prior art. When the invention is not being used, they can be easily carried by the user, either in a backpack, shoulder bag, waist bags, or slung over the shoulder. The relative flatness of the invention makes it easier to carry, by taking up less room, even when two attachments are stacked together.

The prior art, as mentioned above, typically used curved or bulky attachments that remain wide and bulky to carry when not in use. The invented apparatus' relative flatness means that unused attachments can be stacked together and carried flat.

Second, since the materials used are lightweight, relatively soft, and flexible, they can be carried comfortably around a skier's waist, in a backpack or bag, or slung over the skier's shoulder.

Third, these three embodiments are easily attached to the bottoms of the ski boots and are easily removed. The attachment and removal of the invented apparatus is similar to—and as easy as—wearing common walking sandals. The methods of attachment are easier to learn, easier to repeat, and quicker than even the use of ski bindings because, for example, people are more familiar with the straps used on sandals than the multiplicity of designs of bindings used on skis and attachment methods from the prior art for ski boot walking attachments. These ways of attaching the apparatus also provide cost and weight savings in construction.

The bootstraps, used as the means for attaching the first embodiment of invented apparatus, can be made from commonly available off-the-shelf straps, such as the ubiquitous Velcro® strap. The use of straps to attach the invented apparatus is an improvement over the prior art in that it eliminates the added bulk, weight, and expense of the clips used in the prior art, for example, those present in Frey '880 and Bunke '504.

Fourth, these embodiments can be made from inexpensive, commonly available, and lightweight materials, and are easily manufactured. Thus, they can offer the manufacturer a relatively high profit margin while simultaneously being sold inexpensively to the consumer.

The footbed of these embodiments can be made from a multiplicity of readily available injection-molded elastomer or elastomeric foams or other polymer foams. The materials used in the ball-of-foot fulcrum can be the same or similar compounds, albeit more dense and less springy.

Most importantly, the springiness of the undersole material solves the primary problem that is the focus of ski boot walking attachments: it aids the wearer in walking and make walking easier while wearing ski boots.

Basically, the mechanics of walking operate roughly in this fashion: the heel comes down first, compressing the heel portion of the apparatus, and the foot rocks forward as the person moves forward, rolling more weight onto the ball of the foot and toes as the heel rises and uncompresses, thereby compressing the toe portion of the apparatus and also compressing the fulcrum and rocking over it simultaneously. Then, the user pushes off from the toes and ball of the foot, assisted by the return of the fulcrum and toe portion of the apparatus to their original shapes, until the foot completely leaves the ground and is swung forward by the leg.

Illuminating this simple action, the heel of the apparatus compresses when the user first steps down on the heel of the boot. Like a compressed spring, the springy heel material of the apparatus builds potential energy through compression, and that energy is released as the foot rocks forward, thereby pushing upward on the heel, and helping to propel the wearer forward. As the heel comes up, the foot simultaneously rocks forward onto the ball of the foot and toe area. This area of the apparatus likewise compresses as weight is put onto it. Simultaneously, the fulcrum under the ball of the foot compresses as well, and the ski boot rocks over the fulcrum. As the step completes, the toe portion of the apparatus releases its compressed energy, as does the fulcrum, providing more energy to the user, pushing off during the step's completion.

Lastly, while the apparatus is attached to the sole of the boot, the boot is protected from scratches, gouges, and wear, thus extending the potential life of the boot.

The fourth embodiment of the apparatus is a departure from the first two embodiments in that it is integrated into the boot itself, but accomplishes most of the same functions. The heelpiece and toepiece of the boot are attached with hinges to the rest of the boot. Springs sandwiched between the toepiece and boot and between the heelpiece and boot provide the springing action while walking that is described above. That is, stepping down on the heel compresses the spring or spring-like mechanism, thereby compressing the heelpiece against the boot, which releases its energy as the boot rocks forward. The toepiece next compresses against the boot (as the spring between the toepiece and boot compresses) as pressure is pushed downward on the ball of the foot and toe of the boot. As the walker pushes off the boot, finishing the step, the spring or spring-like mechanism in the toe section releases, giving the walker its kinetic energy and assisting the step.

The heelpiece and toepiece are held against the boot (and their springs compressed) while skiing. A pin is used to maintain this compression while the boot is in the ski binding. The pin is inserted laterally into the sole of the boot, holding the extending, toepiece and heelpieces against the remainder of the boot, while keeping the springs compressed.

This fourth embodiment provides the same walking improvement over the prior art, as the first, second, and third embodiments: the toepiece and heelpieces offer springiness to the step, aiding the natural walking function.

Further, they add only a very minimal additional weight to the existing boot, and are made of the same material as the boot itself, thus also saving on the costs of production. The only additional pieces required—beyond that of the existing boot itself—are springs, hinges, and pins. All of these items are inexpensive and widely commercially available.

DETAILED DISCLOSURE OF THE INVENTION AND MODES FOR CARRYING OUT THE INVENTION

Figure 1:
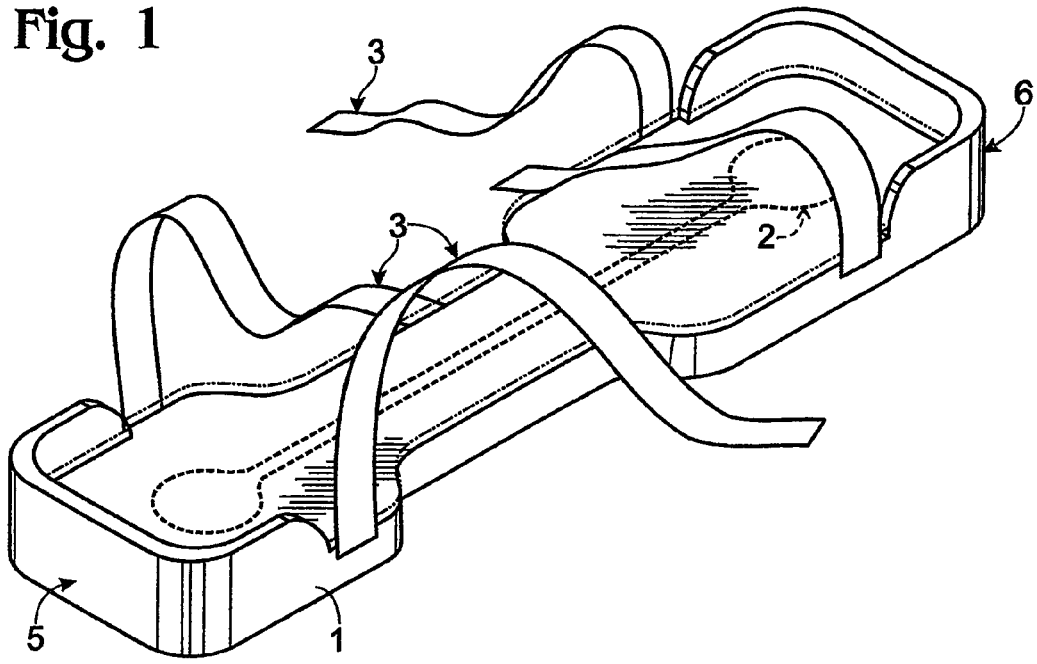
FIG. 1 shows the first embodiment of the invented apparatus, showing generally the footbed and attaching bootstraps.
Figure 2:
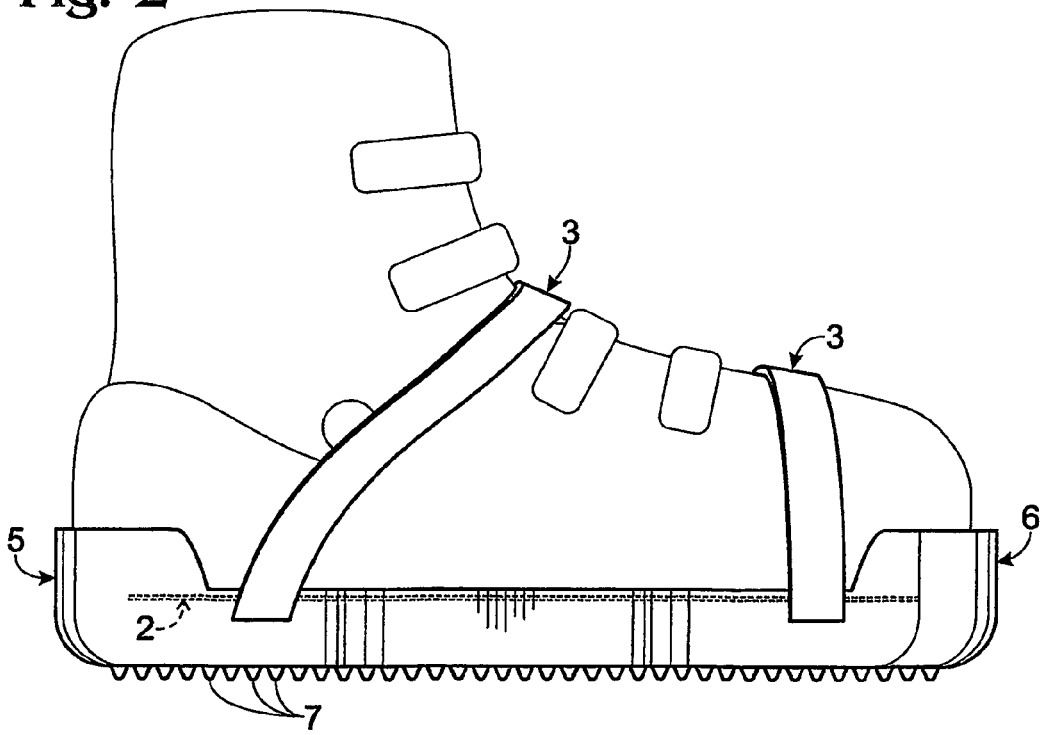
FIG. 2 is a view of the first embodiment attached to a common, commercially available ski boot, showing optional tread on the underside of the apparatus.

Referring particularly to the drawings, FIG. 1 shows the first embodiment of the invented apparatus, the simplest configuration of the invention. The apparatus comprises of five basic pieces: one springy, compression footbed, 1, an optional, encapsulated lengthwise, rigid stringer, 2, an optional, slippery, footbed-covering film, bootstraps, 3, for attaching to the ski boot, and tread covering the bottom of the footbed (as shown in FIG. 2) for traction.

The exact construction of the footbed can be varied, and should follow manufacturing constraints. For descriptive purposes and not to imply that the footbed must comprise of only a single piece, the footbed is shown in FIG. 1 as a one piece, relatively flat, elongated rectangular piece, and with rounded corners and walls that curve up over the front and rear of the ski boot, just as the sole of a shoe or the sole of a boot curves up, covering the shoe or boot material toe and heel.

As mentioned, on each end of the footbed, where the heel and toe portions of the footbed are, there are curved walls, 5 and 6, respectively, which rise roughly perpendicular to the footbed. The curved walls rise higher than the top surface of the footbed and will both grip the toe and heel of the ski boot, as well as protecting them. The exact height of the toe and heel curved walls is not crucial, so long as these two functions are served.

By necessity, the ends of the footbed are longer and wider than the sole of the ski boot it will be attached to, so that the curved walls can fit around the sole of the boot. The invention can be manufactured to provide a custom fit with particular models of ski boots, or it can come in standard sizes, like the boots themselves. The exact dimensions of the footbed and curved walls can be varied, so long as they can be made to fit onto the bottom of a ski boot, with the top surface of the footbed fitting approximately flush, flat with the sole of the ski boot, and the inside of the curved walls fitting approximately flush against the toe and heel of the ski boot, as shown in FIG. 2.

The exact shape of the footbed can be varied to fit manufacturing constraints. The central portion of the footbed can be narrower laterally, for design considerations or to save on the cost materials. Alternatively, the sides of the footbed can be somewhat wider than the sole of the ski boot to provide greater stability laterally.

Further, although this is not shown in the figures, the curved walls may wrap all around the bed, if desirable for manufacturing or aesthetic reasons. This alteration would make the footbed look similar to a butter dish.

The footbed can be made from one or more of a myriad of materials, so long as the basic, required functions are satisfied: the material can be compressed under pressure, is sufficiently resilient to return to its original shape when not under pressure, and provides springiness and energy return while returning to its original shape. The material must return to its original shape and width after each step and must be sufficiently durable to act in this function over the desired life of the product and function well in cold weather.

Many types of potential materials are commonly commercially available and used in the footwear industry, particularly the running shoe industry. The material must be made of a relatively soft, flexible material which can withstand a wide range of temperatures, and yet maintain its properties of springiness and flexibility. The primary function of the material is to provide springiness while walking. The material should be an elastomer or elastomeric foam. Although it is not necessary for the invention, suggested materials include polymers like EVA (ethylene vinyl acetate), "Neoprene" (polychloroprene), or polyurethane foam. Foam can be "closed" or "open cell," depending on manufacturing constraints and/or desired lifespan of the product. These materials are widely commercially available and are ubiquitous in the footwear industry.

Further, as noted above, the footbed can comprise of more than one piece, such as the use of more than one layer of elastomer or elastomeric foam, to give different characteristics or durability. A removable or permanent insole can also be used, just as used with shoes, to change the springiness characteristics of the footbed.

As an additional layer of material, the front or toe-half of the footbed may contain a molded convex-shaped wedge of more dense material that can provide an extra fulcrum for the foot during the walking motion. This alteration to the first embodiment can be located along the metatarsal-phalanges joint of the foot, also known as the "ball" of the foot area. This extra material can provide a denser area to aid the walking motion, by allowing the ski boot to spring forward during each step.

An optional improvement to this apparatus is possible and recommended, and is shown in FIG. 1-2. A stiffening material or device can be incorporated lengthwise within or on the topside of the footbed to provide increased stiffness lengthwise. Lengthwise stiffness aids in centering the apparatus during walking. This member is shown in FIGS. 1 and 2 and is referred to as a stringer, 2, as noted above.

The stringer provides more lengthwise rigidity in the footbed and, more importantly, helps the footbed to return to its normal position during the walking motion. Without the stringer, the apparatus, as with any shoe or sandal, has a tendency of trying to slide laterally out from under the ski boot or foot, as it were. The stringer is a stiffening device which will help to re-center the apparatus while the step is taking place and will further re-center the apparatus after each step is complete.

This stringer can be embedded in the footbed longitudinally. The stringer can be a thin rectangular piece, a tubular piece, a solid cylinder, or even shaped like the footbed itself. A possible shape of the stringer is shown in FIG. 1 as having flat, circular ends under the toe and heel portions of the footbed, roughly hour-glass-shaped, but the stringer is not an essential element of the apparatus and the shape illustrated in the figures is not an essential shape for the stringer.

The stringer also can assist in the walking-assisting springing action of the apparatus if it is incorporated into the apparatus in a pre-bowed or arched shape, rather than flat. The function of the device would be similar to that of an automobile leaf spring. If bowed so that the arc's apex is downward and ends upward, the material will assist in the rocking action of the apparatus from heel to toe. If bowed so that the ends face downward and arc upward, the ends will act as additional springs in the heel and toe areas of the apparatus.

Regardless of its shape, the stringer can be made of a myriad of flexible materials, such as a resilient plastic, metal, or wire; if used, it must be constructed of a material that returns quickly to its original shape after being bent, like a spring, and must be harder, more dense, and lack the softness of the footbed material.

On the topside of the footbed, an optional, but recommended, thin, slippery film can cover the area of the footbed contacting the underside of the ski boot. This is shown by a dashed line in FIG. 1. The film can be made of any type of waterproof plastic or organic compound such as polyethylene. Alternatively, the film can be replaced with a slippery coating on the topside of the footbed, such as, as an example only, a Teflon® coating, or a vinyl, latex, polypropylene, plastic, or polyethylene coating. This film, like the stringer, promotes return of the footbed to its original, proper position during each step, as well as keeping the space between the footbed and the ski boot free of snow, ice, and water.

As mentioned, while walking, the ski boot has a tendency to apply lateral forces against the apparatus, which can move the apparatus off center. If the ski boot is allowed some slippage against the top of the footbed, through the use of this film, the apparatus can correct itself and return to its natural position, flush against the ski boot's sole, after the completion of each step.

FIG. 2 shows the invented apparatus attached to a ski boot, as it would be when in use. The bootstraps, 3, are simply wrapped around the ski boot, clasping the footbed, 1, flush against the underside of the ski boot. The bootstraps, 3, can be made of several different materials and can be attached using several different methods, each of which is commonly commercially available and in wide use in the general field of camping, footwear, and sporting equipment, such as backpacks and even skis.

For example, the bootstraps can be clasped using the commonly, commercially available Velcro®-type pieces, so that the ends are merely pressed together, creating a type of closure. Alternatively, the bootstraps can be snapped together using common round, metal clothing snaps, such as those used on windbreaker-type jackets. Alternatively, the ends of the bootstraps can be fastened together using common plastic clasps of the type used on backpacks and on skis and snowboards themselves (the kind used to prevent skis from flying away in the case the biding releases while skiing). In this fashion, the bootstraps themselves can be made from an elastomeric material, nylon, cloth, metal mesh, or a similar material that is flexible, yet strong, lightweight, inexpensive, and collapsible. Whichever clasp system is used, the clasps themselves should be strong, yet lightweight and inexpensive, and easy to operate. Velcro®-type clasps and common plastic clasps mentioned meet these requirements.

The bootstraps themselves can be mounted in a variety of positions. For sturdiness, it is recommended that the bootstraps be mounted through and near the bottom of the footbed, preferably sandwiched inside the footbed, as shown in FIGS. 1 and 2. They should be spaced apart from each other so that they are more effective at holding the footbed against the ski boot, and they should be mounted toward the heel and toe area of the footbed, for the same reason. This way, it is less likely for the heel or toe ends of the footbed to become loose while in use.

It is also possible to use more than two bootstraps, for added stability and sturdiness.

Alternatively, if the attachment of the toe area of the footbed is snug enough against the toe of the ski boot, it may be possible to use a single bootstrap, which would hold the heel area of the footbed against the ski boot. This means of attachment is not recommended, but is possible. It can be accomplished if the curved wall 6 in the toe end of the footbed has a lip near the top of the curved wall that the lip on the toe end of the ski boot's sole can slip underneath. This lip is illustrated in conjunction with the third embodiment, and discussed later, labeled as a lip, 20, in FIG. 8.

FIG. 2 also illustrates how one or more optional, but recommended, treadpieces, 7, can be glued, molded, or sewn onto the underside of the footbed, providing traction on slippery or snowy surfaces. The exact tread design is not crucial to the invention, but the treadpiece(s) should be made of an elastomer which can withstand a wide range of temperatures, and yet maintain the properties of springiness, flexibility, and traction, primarily. Tread materials and designs which can be applied in this invention are commercially available and common in the manufacture of footwear, and, more particularly, hiking boots. Possible materials include blown rubber or synthetic rubber. The treadpieces' material itself can add to the springiness of the footbed, thereby increasing the utility of the apparatus.

Figure 4:
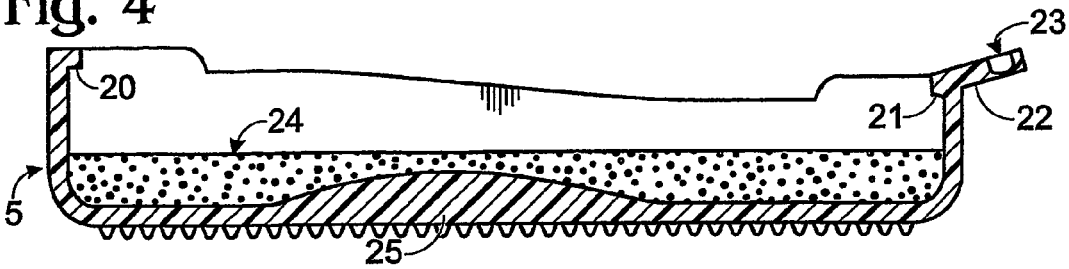
FIG. 4 shows the second embodiment of the invented apparatus, viewed from the right side, in cross-section.
Figure 5:
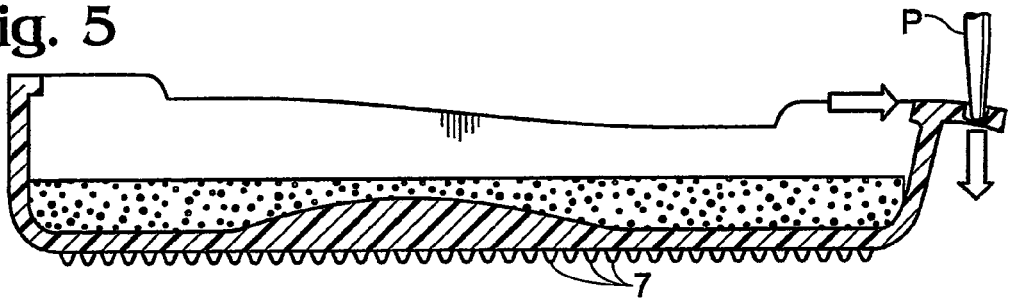
FIG. 5 shows the second embodiment of the invented apparatus, viewed from the right side, also in cross-section, showing the actuation and movement of the toe clip, using the tip of a ski pole pushing downward on the toe clip.
Figure 6:
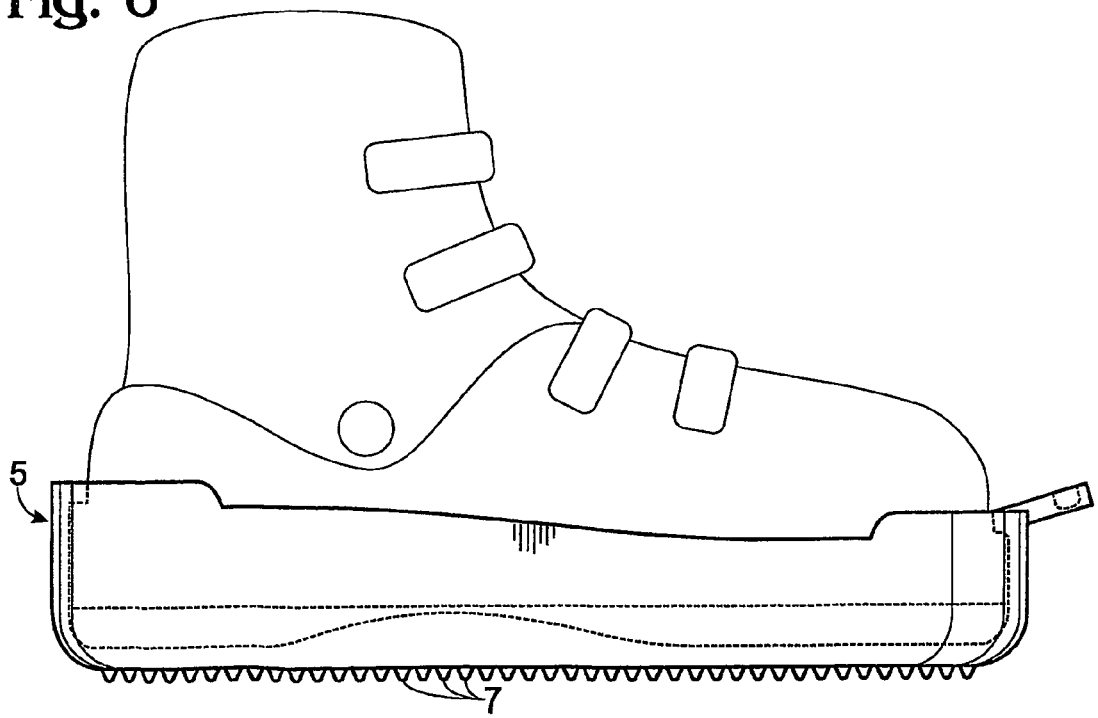
FIG. 6 shows the second embodiment of the invented apparatus, viewed from the right side, attached to the sole of a common ski boot, in the proper configuration for use, also illustrating the optional tread on the underside of the apparatus.

FIGS. 3-7 illustrate the second embodiment of the invented apparatus. The basic functionality and advantages are the same as the first embodiment, but instead of using bootstraps to attach the footbed to a ski boot, the apparatus clips onto the bottom of the ski boot. FIG. 6 shows the apparatus attached to the bottom of the ski boot. This embodiment retains the recommended treadpieces, 7, from the first embodiment, as well as the curved wall, 5, on the rear of the apparatus, both seen in FIGS. 4-6.

Figure 3:
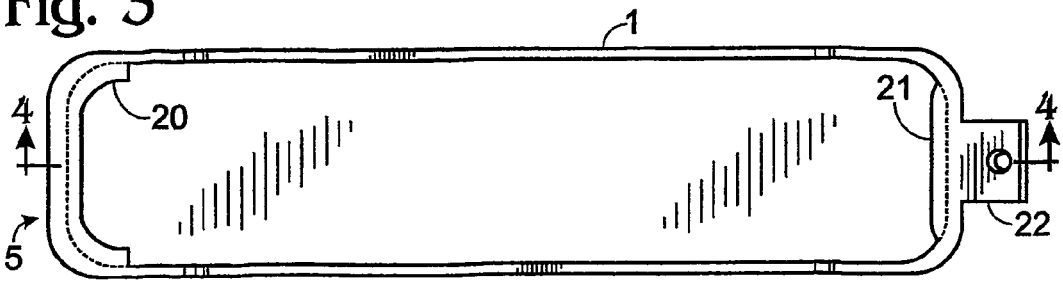
FIG. 3 shows the second embodiment of the invented apparatus, from a top-down view.

The curved wall, 5, on the rear of the apparatus is altered slightly from the first embodiment: it has a lip, 20, or edge on the inside surface, which accommodates the trailing edge of the ski boot, as seen in FIGS. 3-4. The ski boot's heel is slipped into the apparatus, under the lip, which holds the rear of the apparatus against the heel of the ski boot.

As shown in FIGS. 3-6, the front edge of the apparatus has a clip, 21, which holds the front edge of the apparatus against the toe of the ski boot. The clip is operated by downward pressure, as the ski boot wearer steps into the apparatus. The front edge on the toe of the ski boot pushes downward on the clip, thereby pushing it outward. Once the front edge of the toe of the ski boot is past the clip, the clip snaps back to its original position. The clip's edge snaps over the top of the front edge of the ski boot at that point, holding it still.

As shown in FIGS. 3-7, the front edge of the clip has a lever, 22, used to release the clip. To release the apparatus from the bottom of the ski boot, the user can push downward on the lever; this is shown in FIG. 5. FIG. 5 illustrates how a user might press down on the lever with the end of a ski pole, P, (FIG. 5), thereby actuating the lever by bending it downward, pulling the clip away from the front edge of the toe of the ski boot sole, and thereby releasing the ski boot from the apparatus. Particularly evident in FIG. 4, the lever is shown with a small indentation, 23, on its upper surface that accommodates a ski pole, P, (FIG. 5) for this function.

The functionality of the attachment of the second embodiment necessitates that the basic footbed of the apparatus be made of a more rigid material than the first embodiment. The footbed, 1, of the second embodiment is one continuous piece from front to rear. The same general classes and types of materials can be used for the second embodiment, but fabricated in a way so as to make them more dense and rigid. Alternatively, rigid plastic or metal may be used for the footbed of the second embodiment.

Because the second embodiment's footbed is more rigid and supplies less springiness to the stepping action, it is recommended, but optional, that a springy insole, 24, be used inside the footbed. This insole can provide the compression and energy return that assists the walking action: springiness first in the heel area, then in the toe area while walking.

The insole itself should be made from the elastomeric materials described for use in the footbed of the first embodiment.

A further optional, but recommended, improvement to the second embodiment is the use of a curved arch, 25, in the footbed. It can be formed from the material of the footbed itself, or be a separate layer of elastomer or elastomeric foam, as discussed in the first embodiment. The curved arch can roughly match the size and position of that of the arch of the user's foot. It will assist the walking motion as follows: the ski boot will rock over the curved arch during the step, thereby propelling the ski boot forward as it rocks downward over the front edge of the curved arch, in the latter half of the stepping motion.

Figure 7:
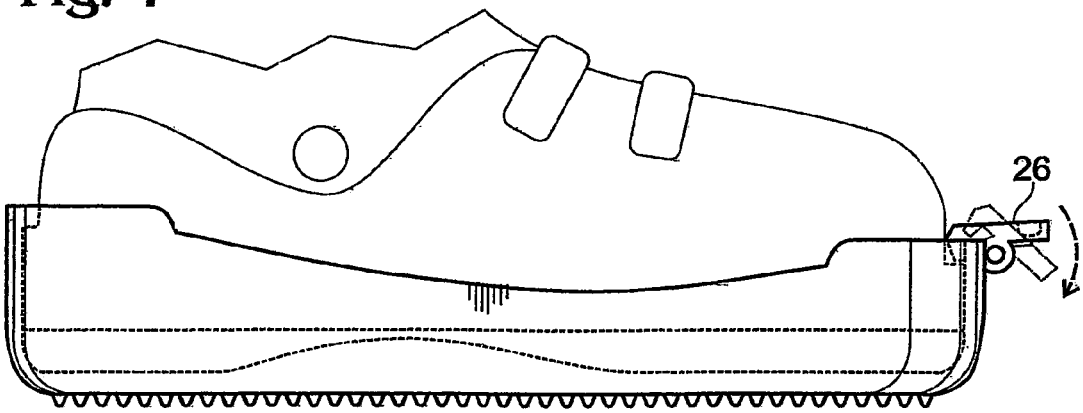
FIG. 7 shows an alternative second embodiment of the invented apparatus, with a hinge-and-spring toe clip, viewed from the right side, attached to the sole of a common ski boot, in the proper configuration for use. The hinging motion of the toe clip is illustrated.

A second, alternative, configuration of the clip can be used in the second embodiment. This is shown in FIG. 7. Rather than using an integrated clip that is actually part of the footbed, a hinged clip, 26, can be attached to the front end of the footbed. This hinged clip is actuated in the same fashion, by pushing down with a ski pole to release the apparatus from the boot. Unlike the single-piece clip, in FIGS. 3-6, a ski pole should also be used with the hinged clip to putting the apparatus on the ski boot, rather than simply stepping into the apparatus, as with the single-piece clip.

The insole, 24, —if used in the second embodiment—can be permanently attached to the footbed, or can be removable and/or replaceable. This can be accomplished with the use of small, commonly commercially available adhesive strips on the underside of the insole.

The third embodiment is shown in FIGS. 8-12. Once again, this embodiment solves the same problems from the prior art and has the same general advantages as the first and second embodiments. The third embodiment uses a slightly more elaborate attachment means than the first two embodiments. Using a footbed similar to that of the first embodiment, the footbed has front and rear sections, 30 and 31, rather than one continuous piece. These two halves slide apart to accommodate the sole of the ski boot, then slide together to grasp the sole of the ski boot. As with the first embodiment, the material used in the footbed sections should be springy, as discussed for that embodiment.

Figure 8:
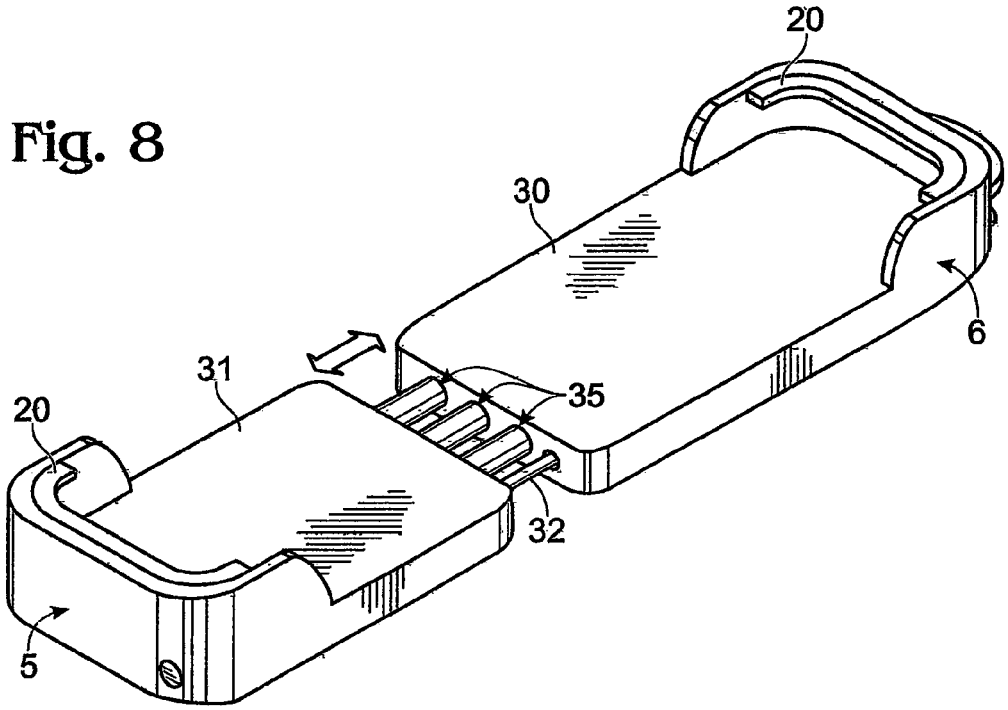
FIG. 8 shows the third embodiment of the invented apparatus, viewed from an oblique angle off the rear (heel) right side, illustrating how the two halves of the apparatus slide together and apart.

As shown on FIG. 8, the front and rear curved walls, 5 and 6, have interior lips, 20, as mentioned and described for the second embodiment. These lips, also shown on FIGS. 8-12, position over the tops of the tailing edge of the heel and the leading edge of the toe of the sole of the ski boot, and hold the apparatus against the underside of the ski boot sole. They function the same way as the lip, 20, on the curved wall, 5, of the rear of the apparatus in the second embodiment, as seen on FIG. 4.

Figure 9:
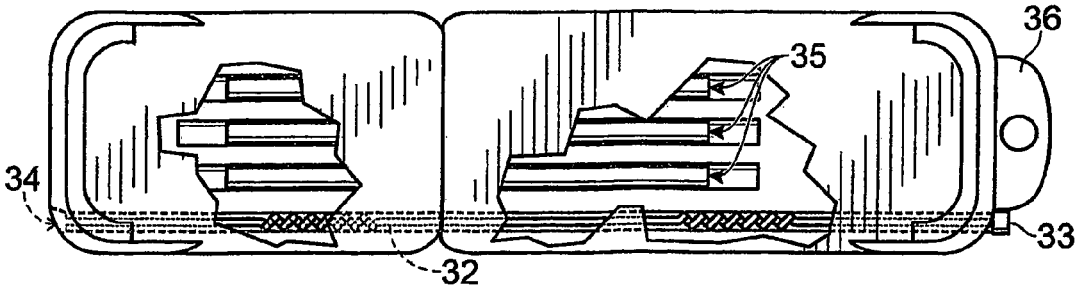
FIG. 9 shows the third embodiment of the invented apparatus, viewed from the top down, shown in cut-away, showing the internal sliding rods and lengthwise spring.
Figure 10:
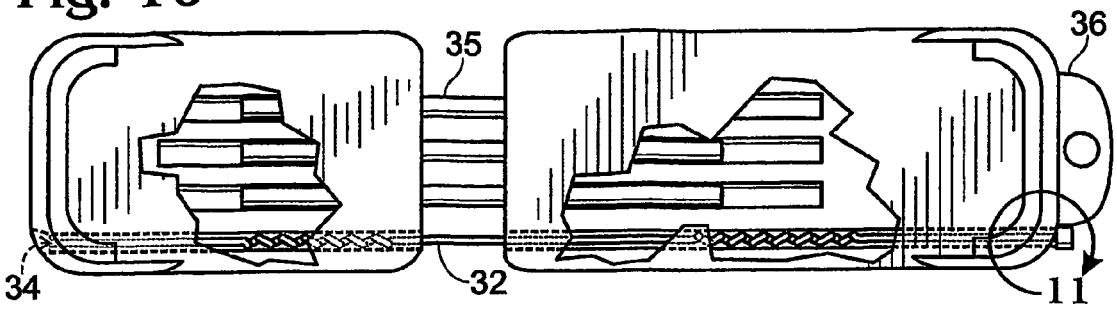
FIG. 10 shows the third embodiment of the invented apparatus, identical to the view of FIG. 9, except the halves of the apparatus are slid apart and spring extended.
Figure 11:
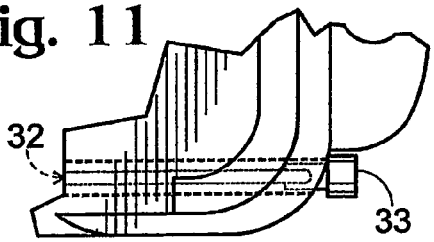
FIG. 11 shows the right front (toe) portion of the third embodiment of the invented apparatus, illustrating the optional anchoring of the lengthwise spring using a tab at the front end.
Figure 12:
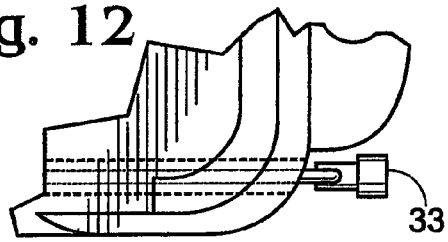
FIG. 12 shows the right front (toe) portion of the third embodiment, identical to FIG. 11, except the spring is extended and the optional tab pulled forward from the front of the apparatus.

The two sections of the footbed used in the third embodiment are held together using an internal spring, 32. The internal spring runs lengthwise through the side of the footbed, through both of the footbed's sections, as shown in FIG. 9-10. This internal spring has tabs, 33, and 34, on each end, through which the internal spring is hooked or attached. The tab at the rear of the footbed, 34, can be fixed to the rear of the footbed. The tabs front and rear are meant to prevent the two sections of the footbed from being pulled completely apart. The exact configuration and material of this internal spring and tabs is not essential, so long as the functions are accomplished: the two halves of the footbed can be pulled apart, but only wide enough to release or accept a ski boot, then spring back together, and have sufficient strength to hold the apparatus on the ski boot while walking. Recommended materials include flexible metal, such as steel, or rigid, but flexible, plastic.

The sections of the footbed should be kept in alignment with each other using one or more rods, 35, which are inserted lengthwise within the footbed halves. The rod or rods slide within channels cut out of the footbed material. The rod or rods assure that the footbed sections slide apart and together in a strictly linear fashion and don't separate from side to side or up and down. These channels can be seen in FIGS. 9-10.

Although optional and not seen in the figures, for added durability, a rod housing can be used inside of the footbed. It can be made of rigid plastic or metal and can be centered inside the footbed's halves. The rod or rods can be placed inside, and slide within, channels cut into the rod housing. The rod housing could run the length of the footbed, to provide this stability and durability and provide attachment points for the tabs at the end of the internal spring. The rod housing, if used, should be lightweight and be inside the material making up the springy material of the footbed itself.

As shown in FIGS. 9-10, the third embodiment will have a flange, 36, that will be used to spread the front and rear halves of the footbed apart for insertion and removal of a ski boot. The flange protrudes off the front end of the apparatus, and has an indentation made to accommodate a ski pole. Like the operation of the second embodiment, the user will first place the heel of the ski boot into the rear of the apparatus—and under the lip, 20, of the curved wall, 5—to attach the apparatus. Then, using the ski pole—inserted into the flange—to hold the front of the apparatus steady, the user will push backward against the rear of the apparatus. This will cause the sections of the apparatus to spread apart, as shown in FIGS. 8 and 10. The user will then step downward on the toe of the ski boot, inserting it under the lip, 20, on the front curved wall, 6, of the apparatus, and then release the ski pole from the flange. This will cause the internal spring to pull the footbed halves together, thereby clasping the bottom of the ski boot and securing the footbed against the bottom of the ski boot. To release the apparatus from the ski boot, the user places the ski pole in the flange, and steadies the front section of the apparatus. The user then pushes rearward on the heel of the ski boot, against the rear curved wall, 5, of the apparatus. Then, the user picks up the toe of the ski boot and pulls the ski boot from the apparatus.

The second embodiment can be altered so that the clip is on the rear of the footbed rather than the front. This is not shown in the figures, but would require only the clip to be on the rear of the footbed and the lip to be on the front of the footbed. The function would be identical.

The third embodiment can be altered so that the flange is on the rear of the footbed, rather than the front of the footbed. The function would be identical.

Figure 13:
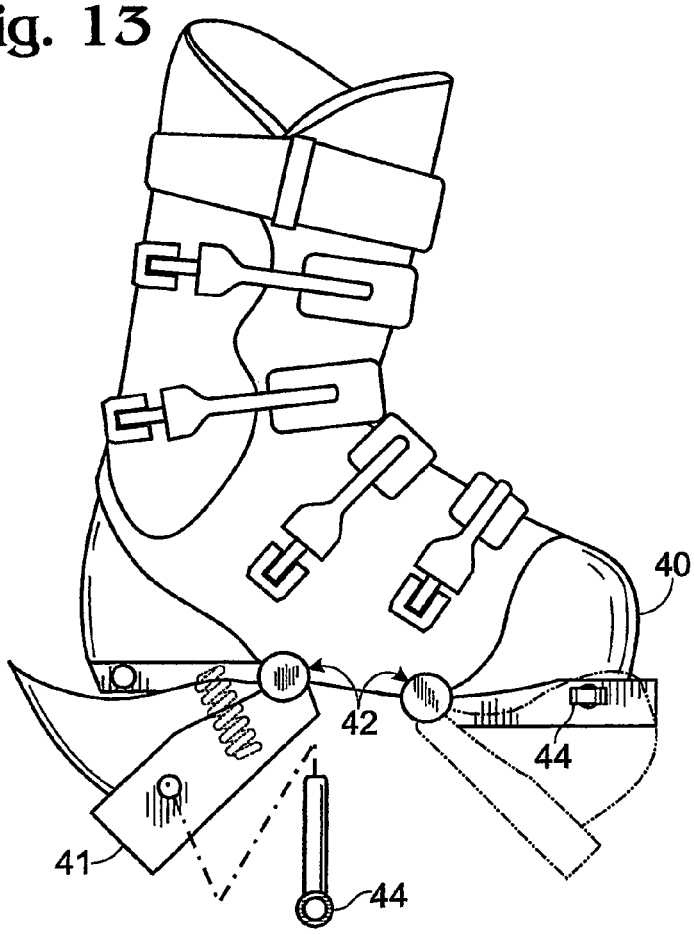
FIG. 13 shows a side view of the fourth embodiment, showing the modified ski boot with heel hinged piece in the appropriate position for walking: with spring extended and piece swung away from the heel of the boot. The internal spring is shown, as well as the removed pin. The toe hinged piece is shown pinned against the ski boot, as it would be when placed against the ski.
Figure 14:
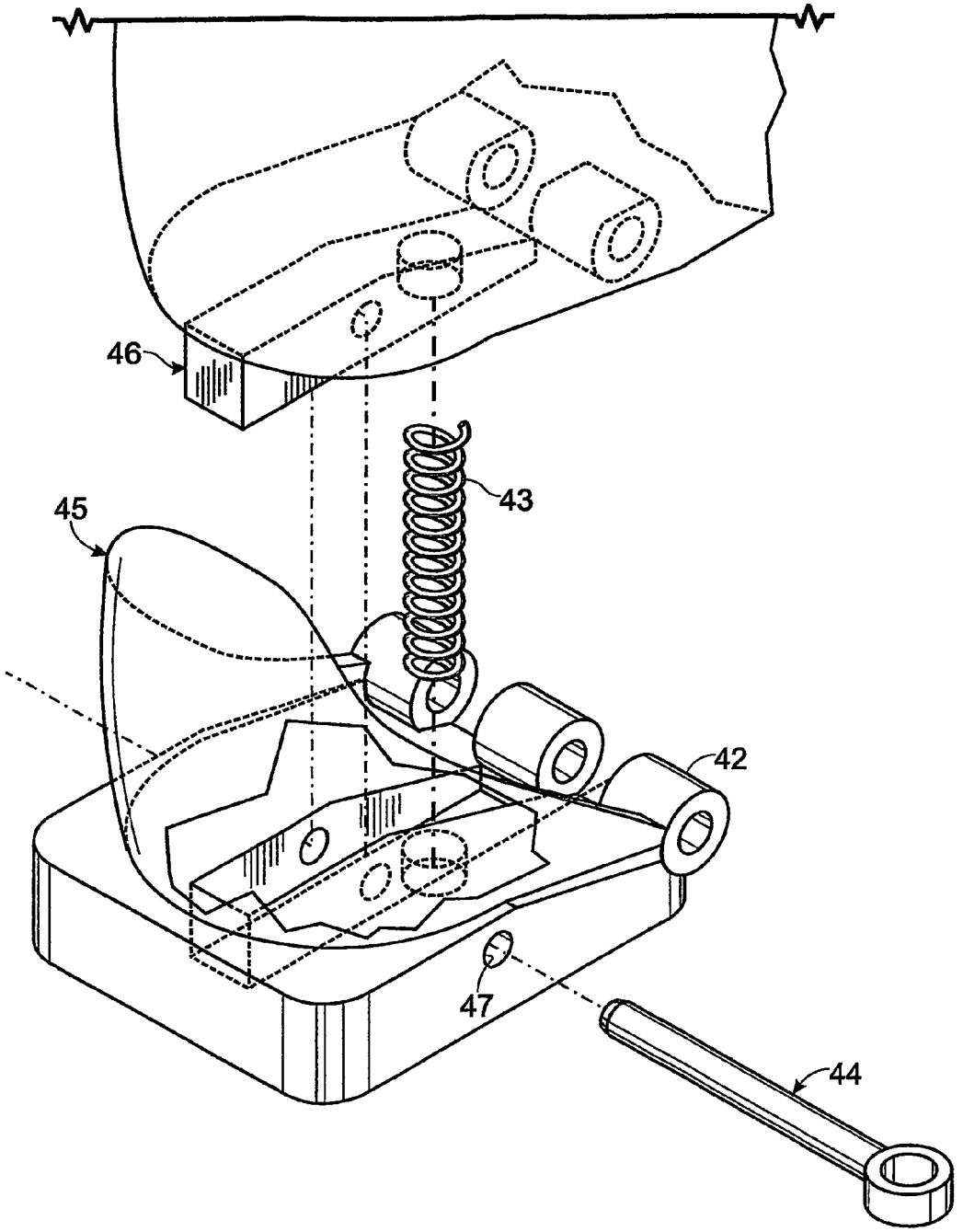
FIG. 14 shows a close-up, cut-away view of the fourth embodiment, more particularly, of the hinged heelpiece, unattached from the ski boot. The heel of the ski boot itself is shown in cut-away, illustrating the hinge and structure; the heelpiece is shown in cut-away, showing hinge and structure. The pin is shown removed, and the spring is shown unattached from either the heel or heelpiece.

The remaining figures, FIGS. 13-14, illustrate the fourth embodiment of the invention. It provides the primary function of the invention—adding spring to the step—which is the primary improvement over the prior art. Basically, the toepiece, 40, and heelpiece, 41, sections are attached to the boot by hinges, 42, that are located in the ski boot sole. Both sections hinge below the ski boot sole while in the appropriate position for walking. The sections are held away from the sole of the boot by the use of one or more springs, 43, (seen more clearly on FIG. 14) or similar springy mechanisms. When the section is compressed against the sole, potential energy is increased, which converts to kinetic energy as the boot rocks forward in the walking motion, just as described earlier in this application, thus providing a spring to the step.

When the toepiece, 40, and heelpiece, sections are compressed against the sole, the bottom surface of the boot is flat, and the boot in function is visually and functionally indistinguishable from unimproved ski boots. While skiing, the sections can be held against the sole using a removable pin, 44, that is pushed laterally through a receiving hole in each hinged section and the boot's sole. This can be seen particularly in the toe area of FIG. 13.

The construction and function of the toepiece, 40, and heelpiece, 41, are the same, except each is a mirror image of the other. Only the dimensions and orientation differ. FIG. 14 shows the internal construction of the heelpiece in cut-away, but it reveals the structure of the toepiece equally. Unless specifically mentioned, each piece has the same function, parts, and basic structure.

The heelpiece section is surrounded by a curved cup, 45, which presses flat against the heel area of the ski boot when the hinged section is compressed against the ski boot's sole. The curved cup protects the hinge and spring and prevents snow or ice from getting between the hinged section and the ski boot sole. This curved cup is shown transparent on FIG. 14, so that the spring and hinge mechanism can be seen.

FIG. 13 shows the boot with heelpiece section extended away from the boot's sole in the proper position for walking. As mentioned, both sections are mounted and operate in the same fashion. The sections are attached to the boot sole using hinges which are mounted on the boot sole, toward the middle of the ski boot sole. With the hinge connecting the heelpiece to the sole mounted toward the middle of the boot's sole, the heelpiece hinges downward at an angle from the boot's sole, such that the apex of the angle is toward the middle of the boot's sole (i.e., at the hinge), while the rear edge of the heelpiece angles downward, scribing an arc away from the rear edge of the ski boot. Similarly, the toepiece is hinged so that the leading edge of the toepiece section can angle away from the toe edge of the boot. When seen from the side, as in FIG. 13, the hinged sections are mounted as mirror images of each other.

The toepiece and heelpiece sections are pushed away from the sole using one or more springs which are mounted both to the hinged sections and the sole itself. The spring provides resistance to downward walking forces but are compressed by an average person's body weight with natural walking action. The spring also prevents the hinged portion from hinging too far from the bottom of the ski boot. Since the ends of the spring are attached to the ski boot and hinged piece, the hinged piece will not hinge away more than a few inches from the bottom of the ski boot.

Both the toepiece and heelpiece sections (particularly seen in FIG. 14) are roughly square when viewed from above. The bottom of the pieces are flat, just as an unaltered ski boot is. The top side of each piece has at least one long, rectangularly-shaped channel cut into it, from the hinge to near the inside of the cup, as seen in FIG. 14. This rectangularly-shaped channel accommodates a protrusion, 46, on the bottom of the ski boot itself, which has the same shape and fits inside the rectangularly-shaped channel when the heelpiece is against the boot. This combination of rectangularly-shaped channel and protrusion was intended to guarantee that the hinged piece remains laterally stable when pinned.

The drawings in FIGS. 13-14 show only a single protrusion and rectangularly-shaped channel, but the apparatus may use more than one mated pair of this concept. A single pair is shown and described for simplicity and because it is superior to more, in that construction and function is more facile. This method of fitting the toepiece and heelpiece against the ski boot eliminates the need for more complex mechanisms of attachment.

Both the boot's sole and the toepiece and heelpiece sections have a hole, 47, drilled laterally that can be used to insert a pin that will hold the section against the boot's sole. The pin, 44, is shown in FIGS. 13-14: any strong, straight metallic or sturdy plastic pin can be used, so long as it fits snugly within the hole, such that it will not readily come out, except when desired by the user, to release the hinged sections. The pin is pushed laterally into the hinged section when the hinged section is compressed flat against the boot's sole. It engages the protrusion on the boot's sole, thus connecting the hinged section to the boot sole and keeping the spring compressed.

Once again, a single hole for a single pin in each hinged section is illustrated for the sake of simplicity. More than one hole laterally through each hinged piece can be used, but is not recommended because it adds complexity without increased utility.

The fourth embodiment may use an alternate method of attaching the hinged pieces. Rather than hinging the toepiece and heelpiece toward the center of the ski boot's sole, the hinges can be placed toward the toe area and heel area, respectively. If this configuration is used, the toepiece and heelpiece will drop beneath the ski boot's sole in the same fashion, subscribing an arc, but they will drop away from the center of boot, rather than the ends of the ski boot. This configuration is not shown in the figures, and would not require the use of the curved cup for each hinged piece. The function of this configuration is the same as the original configuration, but this configuration is disfavored compared to the attachment noted above.

I claim:

1. An apparatus that attaches to the underside of ski boots that assists walking while wearing said ski boots, comprising:

a. a semi-rigid footbed with a roughly flat bottom;

b. an attachment means for removably attaching said footbed to the underside of said ski boots, said attachment means further comprising a clip at one end of said footbed which engages the front or rear edge of the sole of said ski boot, and a lip of rigid material on the inside opposite end of said footbed which fits over the top of the upper edge of the end of said ski boot's sole opposite said clip;

c. one or more elastomeric tread pads connected to the underside of said footbed, which provide traction while walking, and;

d. a pad, made from resiliently elastic material that provides springiness while walking, attached on top of said footbed.

2. An apparatus that attaches to the underside of ski boots that assists walking while wearing said ski boots, comprising:

a. a footbed with a molded arch, with said molded arch's apex pointing upward;

b. an attachment means for removably attaching said footbed to the underside of said ski boots, and;

c. one or more elastomeric tread pads connected to the underside of said footbed, which provide traction while walking, and;

d. a pad, made from resiliently elastic material that provides springiness while walking, attached on top of said footbed.

* * * * *